US009334857B2

(12) United States Patent
Hippe

(10) Patent No.: US 9,334,857 B2
(45) Date of Patent: May 10, 2016

(54) HYDRAULIC PUMP

(71) Applicant: The Boeing Company, Chicago, IL (US)

(72) Inventor: Daniel A. Hippe, Seattle, WA (US)

(73) Assignee: The Boeing Company, Chicago, IL (US)

( * ) Notice: Subject to any disclaimer, the term of this patent is extended or adjusted under 35 U.S.C. 154(b) by 359 days.

(21) Appl. No.: 13/875,405

(22) Filed: May 2, 2013

(65) Prior Publication Data

US 2014/0328695 A1 Nov. 6, 2014

(51) Int. Cl.

| | |
|---|---|
| ***F04B 7/00*** | (2006.01) |
| ***B21J 15/22*** | (2006.01) |
| *F15B 11/032* | (2006.01) |

(52) U.S. Cl.

CPC . *F04B 7/00* (2013.01); *B21J 15/22* (2013.01); *F15B 11/0325* (2013.01)

(58) Field of Classification Search

CPC ..... F15B 11/0325; F15B 7/001; F15B 7/005; F15B 7/04; B21J 15/10; B21J 15/105; B21J 15/20; B21J 15/22

See application file for complete search history.

(56) References Cited

U.S. PATENT DOCUMENTS

| | | | | |
|---|---|---|---|---|
| 2,365,536 | A * | 12/1944 | Fischer et al. | 60/540 |
| 2,844,978 | A | 10/1956 | Wyland et al. | |
| 3,426,530 | A * | 2/1969 | Georgelin | B66F 3/24 60/560 |
| 3,633,365 | A * | 1/1972 | Belknap | F15B 11/0325 60/560 |
| 3,747,194 | A | 7/1973 | Christensen | |
| 4,011,724 | A * | 3/1977 | Landes et al. | 60/567 |
| 4,993,226 | A * | 2/1991 | De Kok | 60/547.1 |
| 5,385,452 | A * | 1/1995 | Lyday | 417/403 |
| 5,483,796 | A * | 1/1996 | Ando | 60/560 |
| 5,649,424 | A * | 7/1997 | Valavaara | F15B 3/00 60/560 |
| 8,312,756 | B2 | 11/2012 | Swinford | |
| 2003/0118459 | A1 * | 6/2003 | Gerhardt et al. | 417/390 |
| 2013/0098240 | A1 | 4/2013 | Wu | |

FOREIGN PATENT DOCUMENTS

| | | |
|---|---|---|
| DE | 19 06 977 | 9/1969 |
| DE | 32 06 613 | 9/1983 |
| DE | 40 22 159 | 5/1991 |
| DE | 40 22 159 A1 | 5/1991 |
| DE | 201 00 122 | 6/2001 |
| DE | 201 00 122 U1 | 6/2001 |

OTHER PUBLICATIONS

International Search Report and Written Opinion, PCT/US2014/032613 (2014).

International Preliminary Report on Patentability, PCT/US2014/032613 (Nov. 3, 2015).

* cited by examiner

*Primary Examiner* — Nathaniel Wiehe
*Assistant Examiner* — Richard Drake
(74) *Attorney, Agent, or Firm* — Walters & Wasylyna LLC

(57) ABSTRACT

A pump including a cylinder body having first and second ends and a cylinder bore, a plug shaft including first and second ends and a plug shaft bore, wherein the first end of the plug shaft is fixed relative to the cylinder body, and wherein the second end of the plug shaft includes a stop, a first piston received within the cylinder bore to partially bound a first gas chamber and a hydraulic fluid chamber, the first piston being received over the plug shaft and axially moveable relative to the plug shaft, a socket shaft including first and second ends and a socket shaft bore, the socket shaft bore being configured to sealingly receive the plug shaft, a second piston received within the cylinder bore to partially bound a second gas chamber and the hydraulic fluid chamber, the second piston being connected to the socket shaft.

19 Claims, 7 Drawing Sheets

HYDRAULIC PUMP

BACKGROUND

The aircraft manufacturing process typically involves joining together various component parts. A wide variety of joining techniques are used, such as riveting, welding, and the like. For example, two structural members of an aircraft may be joined by (1) aligning the structural members; (2) forming a hole through both aligned structural members; (3) inserting a rivet through the hole; and (4) squeezing the rivet such that the rivet is deformed/shaped, coupling the structural members.

The technique used to deform/shape a rivet depends on various factors, such as the location of the rivet and the overall size of the rivet. In many cases, a rivet squeeze tool may be used. An operator positions the rivet squeeze tool over the rivet prior to actuating the tool. Upon actuation, a pump powers a ram of the rivet squeeze tool to engage the rivet to shape the rivet against an anvil. However, commercially available pumps, capable of providing sufficient pressure for deforming/shaping rivets, are typically large and heavy, particularly when the rivets are large and/or formed from a hard durable material. Accordingly, the process of moving and properly positioning the equipment necessary for deforming/shaping rivets may be quite cumbersome and labor intensive.

SUMMARY

In one example, the disclosed pump may include a cylinder body having a first end opposed from a second end along a longitudinal axis, wherein the cylinder body includes a cylinder bore, a plug shaft positioned in the cylinder bore, the plug shaft including a first end, a second end, and a plug shaft bore, wherein the first end of the plug shaft is fixed relative to the cylinder body, and wherein the second end of the plug shaft includes a stop, a first piston sealingly and slideably received within the cylinder bore to partially bound a first gas chamber and a hydraulic fluid chamber, the first piston being sealingly and coaxially received over the plug shaft and axially moveable relative to the plug shaft into engagement with the stop, a socket shaft positioned in the cylinder bore and axially aligned with the plug shaft, the socket shaft including a first end, a second end, and a socket shaft bore, the socket shaft bore being size and shaped to sealingly receive the plug shaft, a second piston sealingly and slideably received within the cylinder bore to partially bound a second gas chamber and partially bound the hydraulic fluid chamber, the second piston being connected to and moveable with the socket shaft.

In another example, the disclosed rivet squeeze assembly may include (1) a rivet squeeze tool that includes a jaw and a hydraulic cylinder connected to the jaw, the hydraulic cylinder including a piston and a shaft extending from the piston into engagement with the jaw, the piston defining a piston chamber and a shaft chamber within the hydraulic cylinder; (2) a pump that includes a cylinder body having a first end opposed from a second end along a longitudinal axis, wherein the cylinder body includes a cylinder bore, a plug shaft positioned in the cylinder bore, the plug shaft including a first end, a second end, and a plug shaft bore, wherein the first end of the plug shaft is fixed relative to the cylinder body, and wherein the second end of the plug shaft includes a stop, a first piston sealingly and slideably received within the cylinder bore to partially bound a first gas chamber and a hydraulic fluid chamber, the first piston being sealingly and coaxially received over the plug shaft and axially moveable relative to the plug shaft into engagement with the stop, a socket shaft positioned in the cylinder bore and axially aligned with the plug shaft, the socket shaft including a first end, a second end, and a socket shaft bore, the socket shaft bore being size and shaped to sealingly receive the plug shaft, a second piston sealingly and slideably received within the cylinder bore to partially bound a second gas chamber and partially bound the hydraulic fluid chamber, the second piston being connected to and moveable with the socket shaft; and (3) a hydraulic fluid line extending from the pump to the rivet squeeze tool to fluidly couple the piston chamber of the rivet squeeze tool with the plug shaft bore of the pump.

In another example, disclosed is a method for actuating a hydraulic actuator that includes (1) in a first stage, supplying a first volume of hydraulic fluid to the hydraulic actuator, the first volume being supplied at a first pressure; and (2) in a second stage, supplying a second volume of hydraulic fluid to the hydraulic actuator, the second volume being supplied at a second pressure, wherein the second pressure is greater than the first pressure.

In yet another example, disclosed is a method for squeezing a rivet that includes (1) positioning the rivet in a rivet squeeze tool; (2) supplying a first volume of hydraulic fluid to the rivet squeeze tool at a first pressure to engage the rivet with the rivet squeeze tool; and (3) supplying a second volume of hydraulic fluid to the rivet squeeze tool at a second pressure to squeeze the rivet.

Other examples of the disclosed rivet squeeze assembly and method will become apparent from the following detailed description, the accompanying drawings and the appended claims.

DETAILED DESCRIPTION

Figure 1:
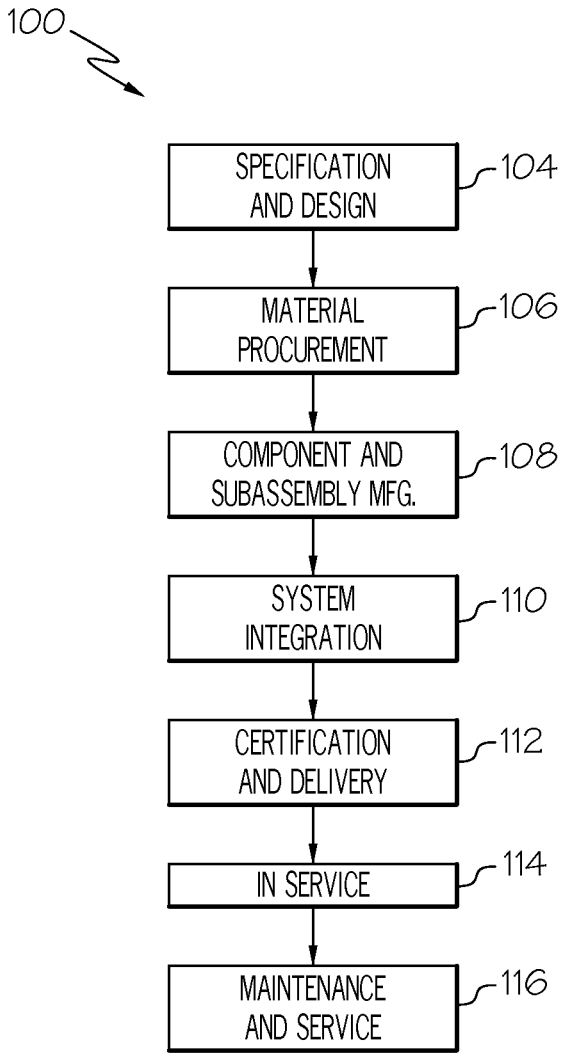
FIG. 1 is a flow diagram of aircraft production and service methodology.

The following detailed description refers to the accompanying drawings, which illustrate specific examples of the disclosure. Other examples having different structures, features and operations do not depart from the scope of the present disclosure. Like reference numerals may refer to the same element or component in the different drawings.

Figure 2:
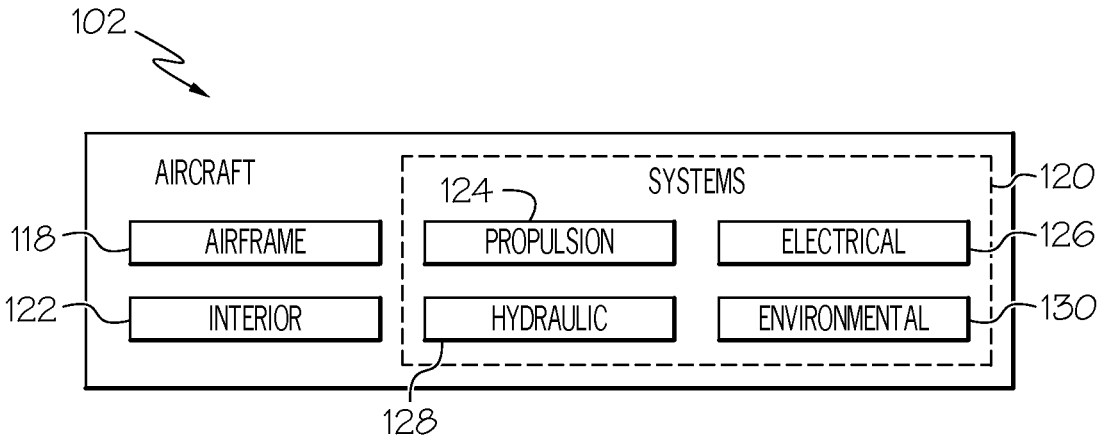
FIG. 2 is a block diagram of an aircraft.

Referring more particularly to the drawings, examples of the disclosure may be described in the context of an aircraft manufacturing and service method 100, as shown in FIG. 1, and an aircraft 102, as shown in FIG. 2. During pre-production, example method 100 may include specification and design 104 of the aircraft 102 and material procurement 106.

During production, component and subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 2, the aircraft 102 produced by example method 100 may include an airframe 118 with a plurality of systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the invention may be applied to other industries, such as the automotive industry.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus examples, method examples, or a combination thereof may be utilized during the production stages 108 and 110, for example, by substantially expediting assembly of or reducing the cost of an aircraft 102. Similarly, one or more of apparatus examples, method examples, or a combination thereof may be utilized while the aircraft 102 is in service, for example and without limitation, to maintenance and service 116.

Figure 3:
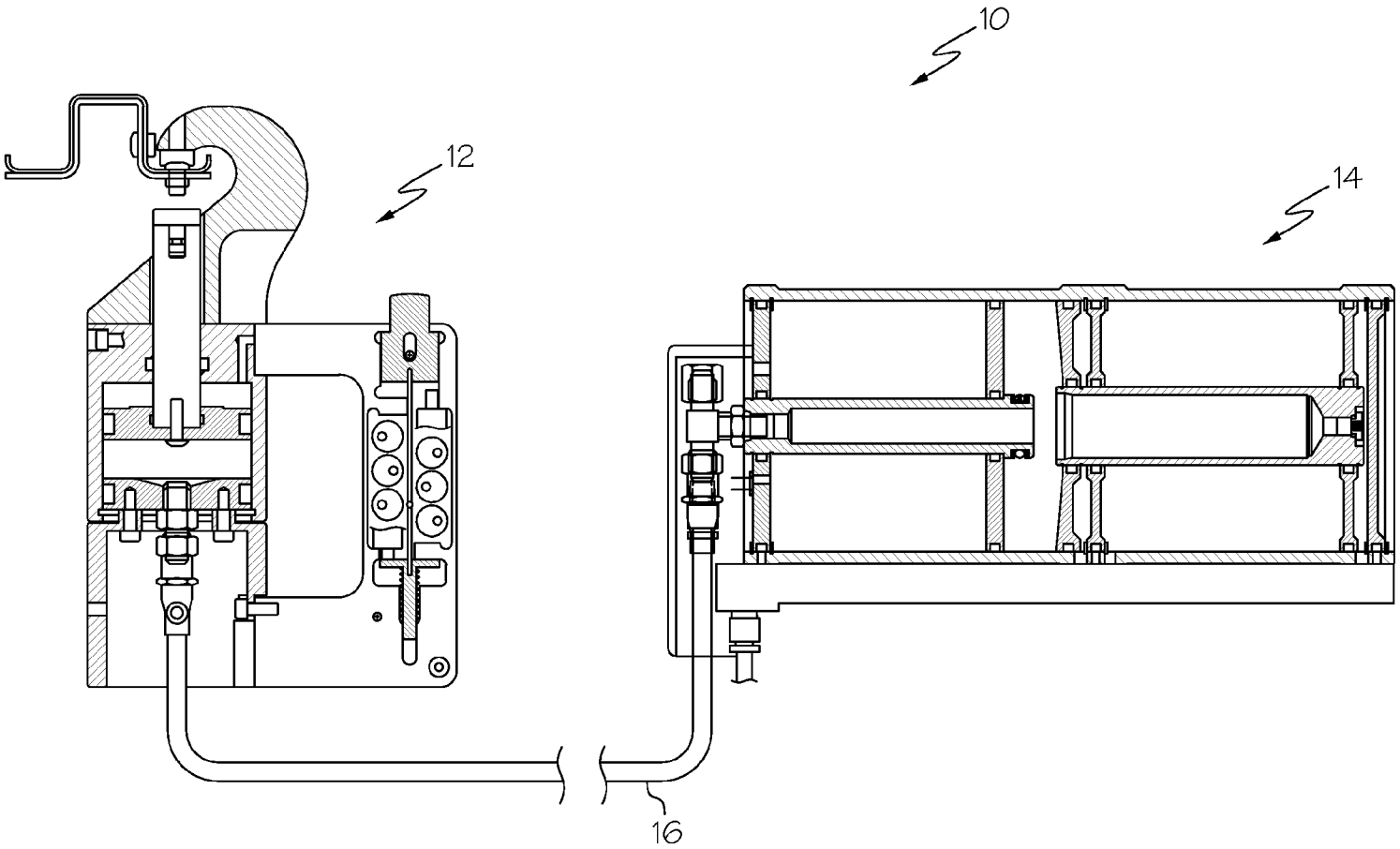
FIG. 3 is a side elevational view, in section, of one example of the disclosed rivet squeeze assembly.

Referring to FIG. 3, one example of the disclosed rivet squeeze assembly, generally designated 10, may include a rivet squeeze tool 12 and a hydraulic intensifier pump 14. A hydraulic fluid line 16 (e.g., a hose) may fluidly couple the hydraulic intensifier pump 14 to the rivet squeeze tool 12 such that the hydraulic intensifier pump 14 may supply pressurized hydraulic fluid to the rivet squeeze tool 12 to actuate the rivet squeeze tool 12.

Figure 4:
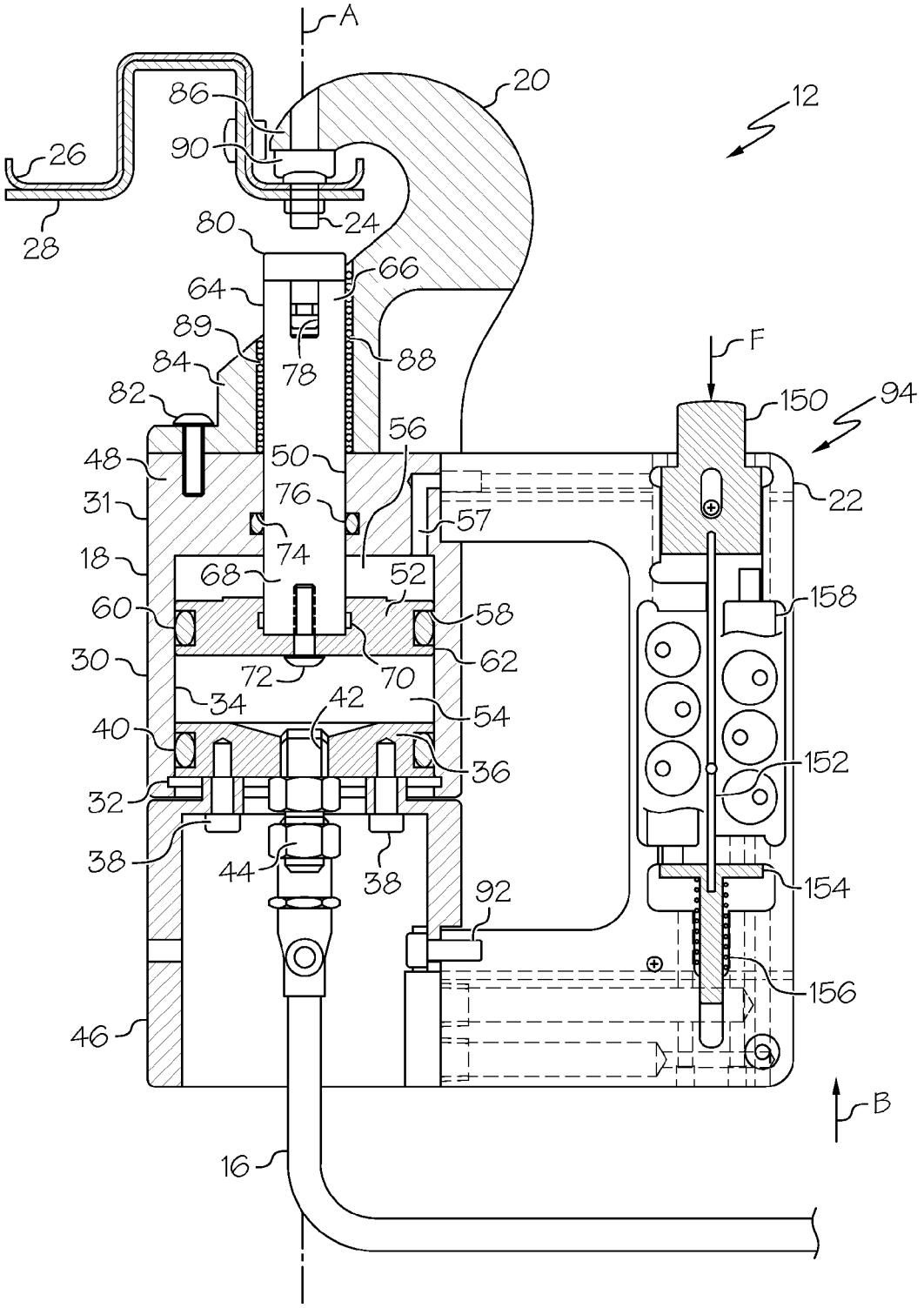
FIG. 4 is a side elevational view, in section, of the rivet squeeze tool of the rivet squeeze assembly of FIG. 3.

Referring to FIG. 4, the rivet squeeze tool 12 may include a hydraulic cylinder 18, a jaw 20 and a handle assembly 22. The rivet squeeze tool 12 may be actuated (as described in greater detail below) to squeeze a rivet 24 extending through two members 26, 28, thereby joining the first member 26 to the second member 28.

The hydraulic cylinder 18 may include a barrel 30. In one example, the barrel 30 may extend along a longitudinal axis A, and may include a first end 31 and a second end 32 longitudinally opposed from the first end 31. A piston bore 34 may be provided in the barrel 30 and may longitudinally extend from proximate (at or near) the first end 31 of the barrel 30 to proximate the second end 32 of the barrel 30.

An end cap 36 may be closely received within the piston bore 34 proximate the second end 32 of the barrel 30. The end cap 36 may enclose the second end 32 of the barrel 30. Mechanical fasteners 38, such as screws, may secure the end cap 36 to the barrel 30. A sealing member 40, such as an O-ring, may be positioned between the end cap 36 and the barrel 30 to provide a fluid-tight seal. For example, the sealing member 40 may be received in an annular groove formed in the end cap 36, as shown in FIG. 4.

The end cap 36 may include a fluid port 42 that extends through the end cap 36. A coupling 44, such as a threaded coupling, may be fluidly coupled to and may extend from the fluid port 42. Therefore, the hydraulic fluid line 16 may be fluidly coupled to the fluid port 42 and, ultimately, to the hydraulic cylinder 18, by coupling the hydraulic fluid line 16 to the coupling 44.

Optionally, a shield 46 may be connected to, and may extend outward from, the second end 32 of the barrel 30. The shield 46 may provide protection to the coupling 44 and the hydraulic fluid line 16 coupled to the coupling 44.

The first end 31 of the barrel 30 may include a head 48 that closes off the barrel 30 proximate the first end 31. The head 48 may be integral with the barrel 30 (i.e., the head 48 and the barrel 30 may be formed as a single monolithic body). Alternatively, the head 48 may be separate from the barrel 30 and connected to the barrel 30, such as by a threaded engagement or with mechanical fasteners (e.g., the head 48 may be similar to the end cap 36). The head 48 may include a shaft bore 50 that may be axially aligned with the barrel 30.

A piston 52 may be closely and slideably received within the piston bore 34 of the barrel 30 to partially bound a piston chamber 54 and a shaft chamber 56. The piston 52 may be moveable relative to the barrel 30 along the longitudinal axis A in response to pressurization of the piston chamber 54 or the shaft chamber 56. Specifically, the piston 52 may move toward the first end 31 of the barrel 30 when the piston chamber 54 is pressurized with hydraulic fluid and the piston may move toward the second end 32 of the barrel 30 when the shaft chamber 56 is pressurized, such as with air.

The piston 52 may include an annular groove 58. A sealing member 60, such as an O-ring, may be received in the annular groove 58 to form a fluid-tight seal between a radial edge 62 of the piston 52 and the barrel 30. Therefore, the piston chamber 54 may be fluidly isolated from the shaft chamber 56, even as the piston 52 moves back and forth along the longitudinal axis A.

A shaft 64 may be connected to, and moveable with, the piston 52. The shaft 64 may include a first end 66 and second end 68.

The shaft 64 may be connected to the piston 52 or may be integral with the piston. In one specific, non-limiting example, the piston 52 may include a recess 70 and the second end 68 of the shaft 64 may be closely received in the recess 70 to connect the shaft 64 to the piston 52. A sealing member, such as an O-ring, may optionally be provided to ensure a fluid-tight seal between the second end 68 of the shaft 64 and the recess 70 of the piston 52. A mechanical fastener 72, such as a screw, may reinforce the connection between the shaft 64 and the piston 52.

The shaft 64 may axially extend from the piston 52, through the shaft chamber 56, through the shaft bore 50, through the shaft bore 88 of the jaw 20, and into engagement with the jaw 20. An annular groove 74 may be formed in the surface of the shaft bore 50. A sealing member 76, such as an O-ring, may be received in the annular groove 74 to form a fluid-tight seal between the shaft 64 and the head 48 of the cylinder 18.

The first end 66 of the shaft 64 may be the working end (the end that engages the rivet 24). The first end 66 of the shaft 64 may include a recess 78 and a plug 80 may be inserted into the recess 78. Various plugs may be insertable into the recess 78 depending on need or application. For example, the plug 80 may modify the length, shape, contour and/or smoothness of the working end of the shaft 64, as will be appreciated by those skilled in the art.

Figure 6:
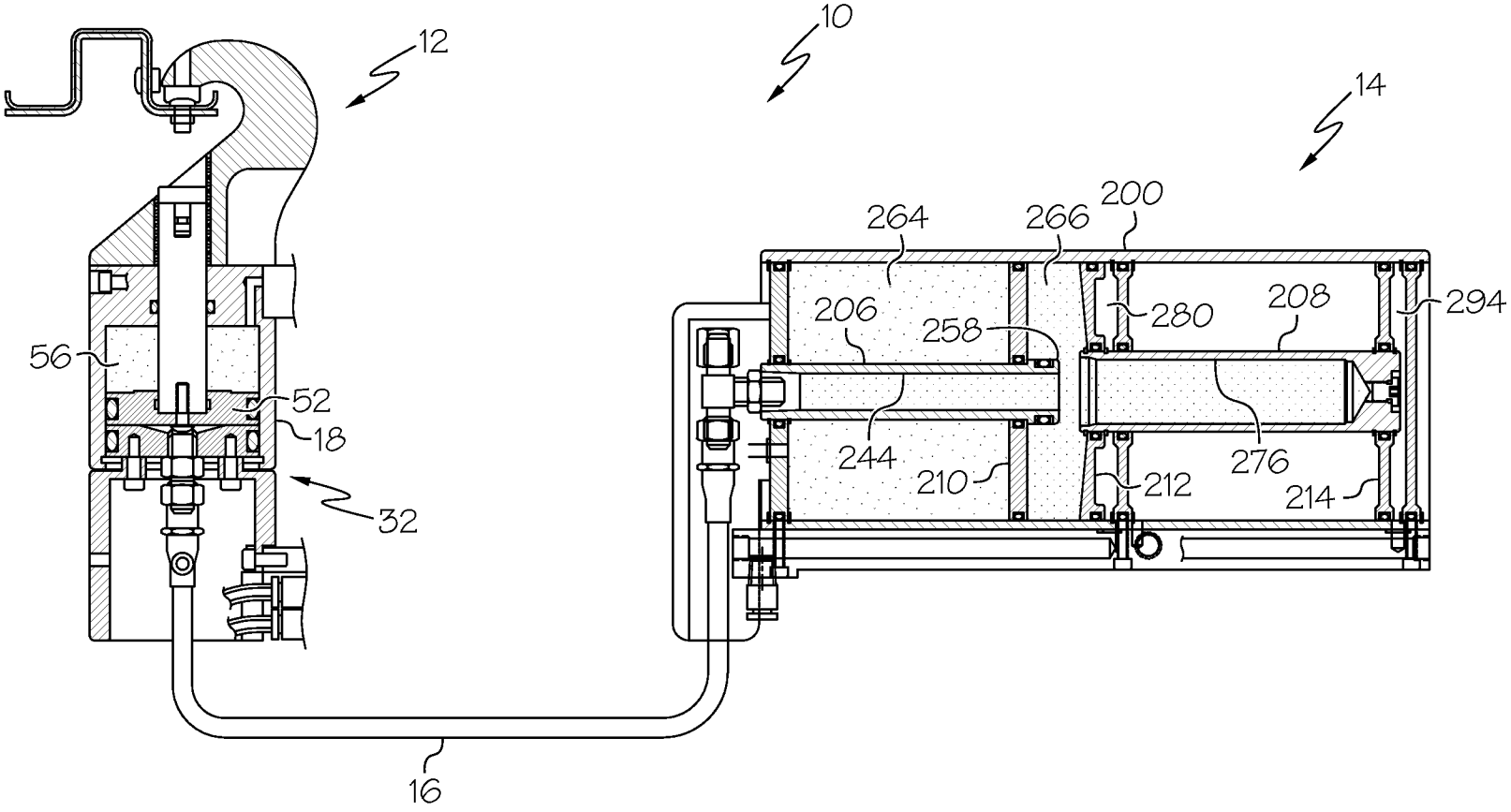
FIG. 6 is a side elevational view, in section, of the rivet squeeze assembly of FIG. 3 shown in a return configuration.

A fluid port 57 may be in fluid communication with the shaft chamber 56. The fluid port may be formed in the head 48 of the barrel 30. The fluid port 57 may selectively vent (e.g., to atmosphere) the shaft chamber 56 when the piston chamber 54 is being pressurized with hydraulic fluid to drive the shaft 64 into engagement with the rivet 24. The fluid port 57 may also selectively supply pressurized fluid (e.g., pressurized air) to the shaft chamber 56 to urge the piston 52 toward the second end 32 of the hydraulic cylinder 18 (corresponding to a return configuration of the rivet squeeze assembly 10, as shown in FIG. 6), such as after a rivet-squeezing operation.

The jaw 20 may be connected to the first end 31 of the barrel 30 proximate the head 48. For example, the jaw 20 may be connected to the barrel 30 with one or more mechanical fasteners 82, though it is also contemplated that the jaw 20 may be integral with the hydraulic cylinder 18.

The jaw 20 may include a base portion 84 and an anvil 86. The base portion 84 of the jaw 20 may be connected to the hydraulic cylinder 18. The anvil 86 may be opposed from the base portion 84. While the jaw 20 is shown in the drawings having a hook shape, those skilled in the art will appreciate that various jaw configurations may be used without departing from the scope of the present disclosure.

The base portion 84 of the jaw 20 may include a shaft bore 88. The shaft bore 88 of the jaw 20 may be axially aligned with the shaft bore 50 of the hydraulic cylinder 18. Therefore, the shaft 64 of the hydraulic cylinder may extend through the shaft bore 88 of the jaw 20 and into engagement with the anvil 86 of the jaw 20. A bushing 89 may be positioned in the shaft bore 88 between the shaft 64 and the surface of the shaft bore 88.

Optionally, a die 90 may be interchangeably coupled to the anvil 86 of the jaw 20. The die 90 may be sized and shaped to receive the head of the rivet 24. Therefore, various dies 90 may be used and the selection of a particular die 90 (e.g., from a kit of dies 90) for connection to the anvil 86 may depend on the type of rivet being squeezed.

The handle assembly 22 may be connected to the hydraulic cylinder 18, such as with mechanical fasteners 92 (e.g., screws), to provide a structure for holding the rivet squeeze tool 12. Additionally, the handle assembly 22 may house an actuation assembly 94 for actuating the rivet squeeze tool 12.

The actuation assembly 94 of the handle assembly 22 may include a push button 150, a push rod 152, a stop 154, a biasing member 156 and a pneumatic valve 158. The push button 150 may be connected to the push rod 152, which may be connected to the stop 154. The biasing member 156, which may be a coil spring or the like, may urge the stop 154 in the direction shown by arrow B, which may urge the push rod 152 in the direction shown by arrow B, which in turn may urge the push button 150 outward (in the direction of arrow B).

Figure 5:
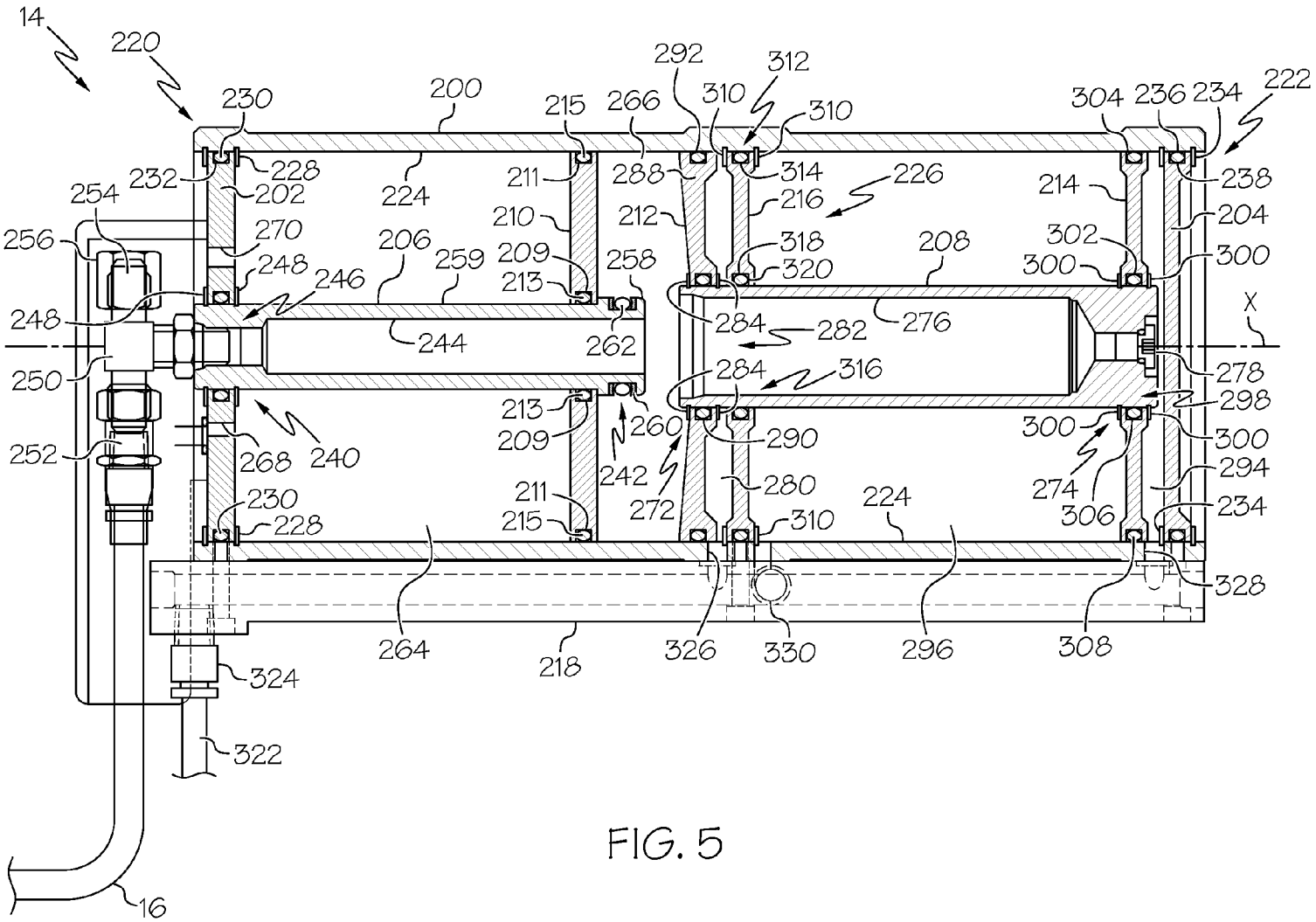
FIG. 5 is a side elevational view, in section, of the hydraulic intensifier pump of the rivet squeeze assembly of FIG. 3.

Referring to FIG. 5, the hydraulic intensifier pump 14 may include a cylinder body 200, a first end cap 202, a second end cap 204, a plug shaft 206, a socket shaft 208, a first piston 210, a second piston 212, a third piston 214, and a baffle 216.

The cylinder body 200 may extend along a longitudinal axis X. The cylinder body 200 may include an open first end 220 and an open second end 222. The cylinder body 200 may include a cylinder bore 224 that longitudinally extends from proximate the first end 220 of the cylinder body 200 to proximate the second end 222 of the cylinder body 200. The cylinder bore 224 may at least partially bound a hollow internal volume 226 of the cylinder body 200.

The first end cap 202 may be closely received within the cylinder bore 224 proximate the first end 220 of the cylinder body 200. The first end cap 202 may enclose the first end 220 of the cylinder body 200. Mechanical fasteners 228, such as retaining rings, may secure the first end cap 202 to the cylinder body 200 to inhibit axial movement of the first end cap 202 relative to the cylinder body 200. A sealing member 230, such as an O-ring, may be positioned between the first end cap 202 and the cylinder body 200 to provide a fluid-tight seal. The sealing member 230 may be received in an annular groove 232 formed in the first end cap 202.

The second end cap 204 may be closely received within the cylinder bore 224 proximate the second end 222 of the cylinder body 200. The second end cap 204 may enclose the second end 222 of the cylinder body 200. Mechanical fasteners 234, such as retaining rings, may secure the second end cap 204 to the cylinder body 200 to inhibit axial movement of the second end cap 204 relative to the cylinder body 200. A sealing member 236, such as an O-ring, may be positioned between the second end cap 204 and the cylinder body 200 to provide a fluid-tight seal. The sealing member 236 may be received in an annular groove 238 formed in the second end cap 204.

The plug shaft 206 may include a first end 240 and a second end 242 longitudinally opposed from the first end 240. The plug shaft 206 may include a plug shaft bore 244 that longitudinally extends from proximate the first end 240 of the plug shaft 206 to proximate the second end 242 of the plug shaft 206. Therefore, the plug shaft 206 may be constructed as an elongated hollow tubular member.

The first end 240 of the plug shaft 206 may extend through an opening 246 in the first end cap 202. Mechanical fasteners 248, such as retaining rings, may fixedly secure the first end 240 of the plug shaft 206 to the first end cap 202 to inhibit axial movement of the plug shaft 206 relative to the first end cap 202.

A coupling 250, such as a T-fitting, may be fluidly coupled to the first end 240 of the plug shaft 206. For example, the coupling 250 may be threaded into engagement with the first end 240 of the plug shaft 206. The hydraulic fluid line 16 may be coupled to the first "T" end 252 of the coupling 250 such that the hydraulic fluid line 16 may be in fluid communication with the plug shaft bore 244. The second "T" end 254 of the coupling 250 may be sealed when not in use, such as with a screw-on cap 256.

The second end 242 of the plug shaft 206 may protrude into the internal volume 226 of the cylinder body 200 and may include a flanged portion 258. The flanged portion 258 may have a diameter that is greater (e.g., at least 5 percent greater) than the diameter of the non-flanged portion 259 of the plug shaft 206. The outer periphery of the flanged portion 258 may include an annular groove 260. A sealing member 262, such as an O-ring, may be received in the annular groove 260 to create a fluid-tight seal between the plug shaft 206 and the socket shaft 208 when the plug shaft 206 is received in the socket shaft 208, as described in greater detail below.

The first piston 210 may be sealingly and slideably received within the cylinder bore 224 and may be closely and slideably received over (coaxially received over) the plug shaft 206 to define a first gas chamber 264 and a hydraulic fluid chamber 266. The hydraulic fluid chamber 266 may be filled with a hydraulic fluid, such as by way of the first "T" end 252 of the coupling 250. The first piston 210 may include an inner annular groove 209 and an outer annular groove 211. An inner sealing member 213, such as an O-ring, may be received in the inner annular groove 209 to form a fluid-tight seal between the first piston 210 and the plug shaft 206. An outer sealing member 215, such as an O-ring, may be received in the outer annular groove 211 to form a fluid-tight seal between the first piston 210 and the cylinder bore 224. Therefore, the first gas chamber 264 may be fluidly isolated from the hydraulic fluid chamber 266, even as the first piston 210 moves back and forth along the longitudinal axis X.

The first piston 210 may be moveable along the longitudinal axis X relative to the cylinder body 200 and the plug shaft 206. The flanged portion 258 of the plug shaft 206 may function as a stop, as shown in FIG. 5, which may inhibit axial movement of the first piston 210 beyond the flanged portion 258 when the first gas chamber 264 is pressurized (e.g., with air) by way of fluid ports 268, 270. The first piston 210 may axially move toward the first end cap 202 when the first gas chamber 264 is vented (e.g., to atmosphere) by way of fluid ports 268, 270, while the hydraulic fluid chamber 266 is pressurized, as described in greater detail below.

The socket shaft 208 may include a first end 272 and a second end 274 longitudinally opposed from the first end 272. The socket shaft 208 may include a socket shaft bore 276 that may longitudinally extend from proximate the first end 272 of the socket shaft 208 to proximate the second end 274 of the socket shaft 208. The socket shaft bore 276 may be open at the first end 272 of the socket shaft 208 and may be closed at the second end 274 of the socket shaft 208. Optionally, a removable plug 278 may seal the second end 274 of the socket shaft 208.

Figure 8:
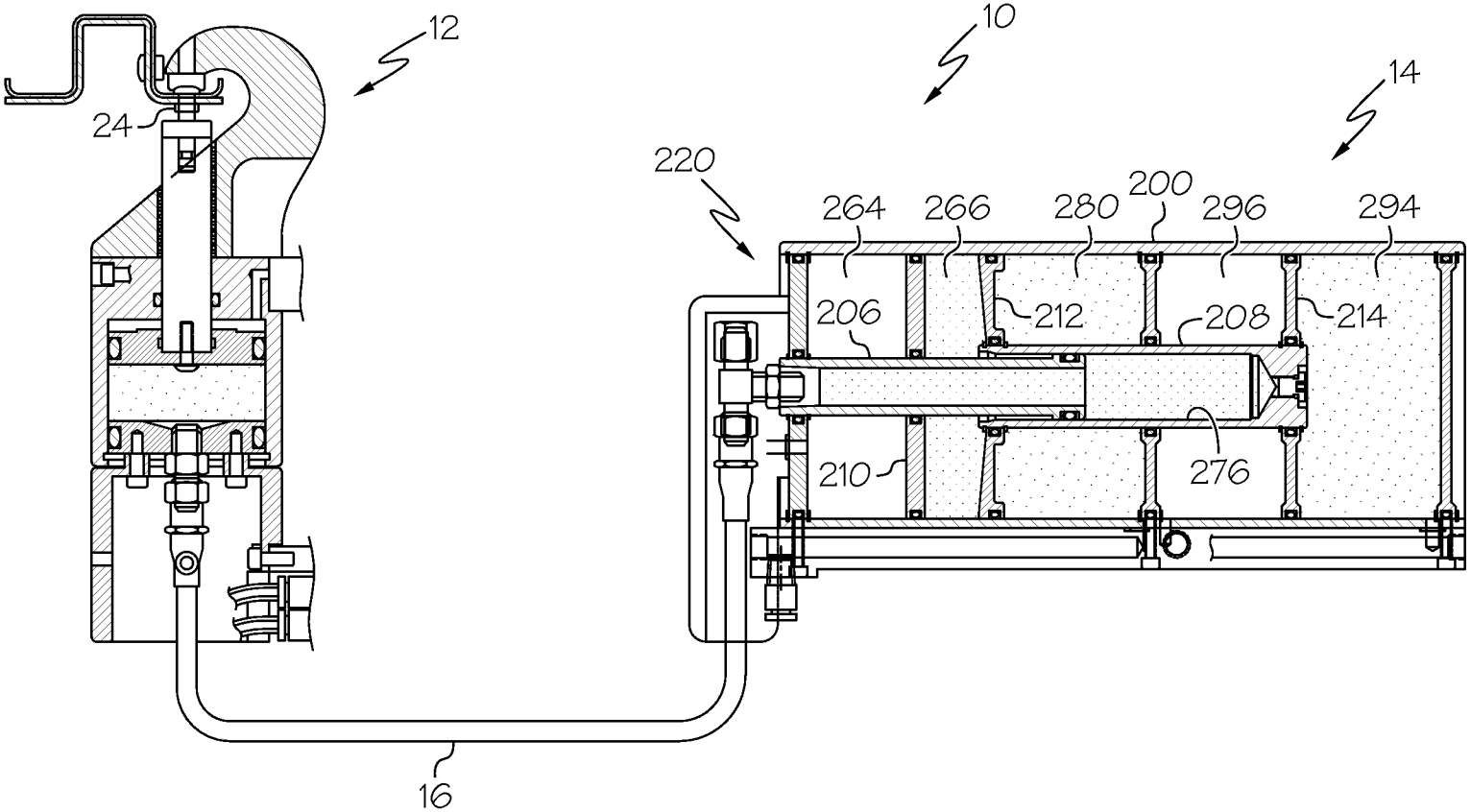
FIG. 8 is a side elevational view, in section, of the rivet squeeze assembly of FIG. 3 shown in a rivet squeeze configuration.

The socket shaft bore 276 may be sized and shaped to closely receive the plug shaft 206 therein, as shown in FIG. 8. Specifically, the socket shaft bore 276 may have an inner diameter that closely corresponds to the outer diameter of the flanged portion 258 of the plug shaft 206. Therefore, when the socket shaft 208 is urged over the plug shaft 206, the sealing member 262 of the flanged portion 258 of the plug shaft 206 may create a fluid-tight seal between the plug shaft 206 and the socket shaft 208 that fluidly and sealingly couples the plug shaft bore 244 with the socket shaft bore 276, while fluidly isolating the coupled shaft bores 244, 276 from the internal volume 226 of the cylinder body 200.

The second piston 212 may be received over and connected to the first end 272 of the socket shaft 208. The second piston 212 may be closely and slideably received within the cylinder bore 224 to partially bound the hydraulic fluid chamber 266 and a second gas chamber 280. The hydraulic fluid chamber 266 may axially extend between the first piston 210 and the second piston 212. The second gas chamber 280 may axially extend between the second piston 212 and the baffle 216 in the annular region between the socket shaft 208 and the cylinder bore 224.

The first end 272 of the socket shaft 208 may extend through an opening 282 in the second piston 212 such that the socket shaft bore 276 opens toward, and is in fluid communication with, the hydraulic fluid chamber 266. Mechanical fasteners 284, such as retaining rings, may fixedly secure the second piston 212 to the first end 272 of the socket shaft 208 to inhibit axial movement of the second piston 212 relative to the socket shaft 208.

The second piston 212 may include an inner annular groove 286 and an outer annular groove 288. An inner sealing member 290, such as an O-ring, may be received in the inner annular groove 286 to form a fluid-tight seal between the second piston 212 and the socket shaft 208. An outer sealing member 292, such as an O-ring, may be received in the outer annular groove 288 to form a fluid-tight seal between the second piston 212 and the cylinder bore 224. Therefore, the second gas chamber 280 may be fluidly isolated from the hydraulic fluid chamber 266, even as the second piston 212 and the connected socket shaft 208 move back and forth along the longitudinal axis X.

The third piston 214 may be received over and connected to the second end 274 of the socket shaft 208. The third piston 214 may be closely and slideably received within the cylinder bore 224 to define a third gas chamber 294 and a vent chamber 296. The third gas chamber 294 may axially extend between the third piston 214 and the second end cap 204. The vent chamber 296 may axially extend between the third piston 214 and the baffle 216 in the annular region between the socket shaft 208 and the cylinder bore 224.

The second end 274 of the socket shaft 208 may extend through an opening 298 in the third piston 214. Mechanical fasteners 300, such as retaining rings, may fixedly secure the third piston 214 to the second end 274 of the socket shaft 208 to inhibit axial movement of the third piston 214 relative to the socket shaft 208.

The third piston 214 may include an inner annular groove 302 and an outer annular groove 304. An inner sealing member 306, such as an O-ring, may be received in the inner annular groove 302 to form a fluid-tight seal between the third piston 214 and the socket shaft 208. An outer sealing member 308, such as an O-ring, may be received in the outer annular groove 304 to form a fluid-tight seal between the third piston 214 and the cylinder bore 224. Therefore, the third gas chamber 294 may be fluidly isolated from the vent chamber 296, even as the third piston 214 and the connected socket shaft 208 move back and forth along the longitudinal axis X.

The baffle 216 may be received in the internal volume 226 of the cylinder body 200 and may be received over the socket shaft 208 to fluidly isolate the second gas chamber 280 from the vent chamber 296. The baffle 216 may be fixed relative to the cylinder body 200. For example, mechanical fasteners 310, such as retaining rings, may fixedly secure the baffle 216 to the cylinder body 200. The baffle 216 may include an outer annular groove 312 and a sealing member 314, such as an O-ring, may be received in the outer annular groove 312 to form a fluid-tight seal between the baffle 216 and the cylinder body 200.

The socket shaft 208 may extend through an opening 316 formed in the baffle 216. Therefore, the socket shaft 208 may pass though the opening 316 in the baffle 216 as the socket shaft 208 moves back and forth along the longitudinal axis X. The baffle 216 may include an inner annular groove 318 and a sealing member 320, such as an O-ring, may be received in the inner annular groove 318 to form a fluid-tight seal between the baffle 216 and the socket shaft 208.

Referring back to FIG. 4, the push button 150 is biased to the un-depressed position. When pressurized air is supplied to the rivet squeeze tool 12 (e.g., when a pressurized air line (not shown) is fluidly coupled to the rivet squeeze tool), the un-depressed position corresponds to the return configuration, shown in FIG. 6. Specifically, in the return configuration of the rivet squeeze tool 12, pressurized air is supplied to the shaft chamber 56 by way of the fluid port 57 to urge the piston 52 toward the second end 32 of the hydraulic cylinder 18 and, correspondingly, the first end 66 of the shaft 64 away from the rivet 24.

The rivet squeeze tool 12 may be actuated by depressing the push button 150 to either a partially depressed position or a fully depressed position. When an applied force F overcomes the biasing force of the biasing member 156 and moves the push button 150 to the partially depressed position, the shaft chamber 56 may be vented and the pneumatic valve 158 may cause pressurized air to be directed to the hydraulic intensifier pump 14 (FIG. 3) to actuate the hydraulic intensifier pump 14 to the pre-load configuration of the rivet squeeze assembly 10 shown in FIG. 7, which is described in greater detail herein. Then, when the applied force F further moves the push button 150 to the fully depressed position, the shaft chamber 56 may remain vented and the pneumatic valve 158 may direct pressurized air to the hydraulic intensifier pump 14 to actuate the hydraulic intensifier pump 14 to the rivet squeeze configuration of the rivet squeeze assembly 10 shown in FIG. 8, which is described in greater detail herein. While a specific actuation assembly 94 is shown and described, those skilled in the art will appreciate that various techniques and apparatus (e.g., various valves and valve assemblies) may be employed to pneumatically actuate the hydraulic intensifier pump 14 to the "return," "pre-load" and "rivet squeeze" configurations described herein.

A manifold 218 may supply pressurized fluid (e.g., pressurized air) such that the hydraulic intensifier pump 14 selectively supplies pressurized hydraulic fluid to the rivet squeeze tool 12 (FIG. 4) by way of the hydraulic fluid line 16. A pressurized fluid line 322 (e.g., a pneumatic line) may be fluidly coupled to the manifold 218, such as at an air fitting 324. The manifold 218 may selectively distribute pressurized fluid (such as air pressurized to, e.g., about 100 psi) to the hydraulic intensifier pump 14 to selectively actuate the hydraulic intensifier pump 14 to the return configuration (FIGS. 5 and 6), the pre-load configuration (FIG. 7), and the rivet squeeze configuration (FIG. 8). Specifically, depending on the configuration desired, the manifold 218 may supply pressurized fluid to the first gas chamber 264 by way of ports 268, 270, to the second gas chamber 280 by way of port 326, and to the third gas chamber 294 by way of port 328. The vent chamber 296 may be vented by way of a vent 330.

Referring to FIGS. 5 and 6, with the push button 150 in the outward (undepressed) position and the rivet squeeze assembly 10 in the return configuration, pressurized fluid (e.g., air) is directed to the first gas chamber 264, while the second and third gas chambers 280, 294 are vented (e.g., to atmosphere). When the first gas chamber 264 is pressurized (e.g., 100 psi), the first piston 210 is urged toward the second end 222 of the cylinder body 200 until it comes into abutting engagement with the flanged portion 258 of the plug shaft 206.

Additionally, in the return configuration, the shaft chamber 56 of the rivet squeeze tool 12 is pressurized (as described above) to urge the piston 52 toward the second end 32 of the hydraulic cylinder 18, thereby causing hydraulic fluid in the piston chamber 54 to return to, and fill, (by way of hydraulic fluid line 16) the hydraulic fluid chamber 266 of the hydraulic intensifier pump 14. As the hydraulic fluid chamber 266 is filled with hydraulic fluid, the pressure within the hydraulic fluid chamber 266 urges the socket shaft 208 (and associated second and third pistons 212, 214) away from the plug shaft 206 (i.e., toward the second end 222 of the cylinder body 200), to the return configuration shown in FIG. 6.

Figure 7:
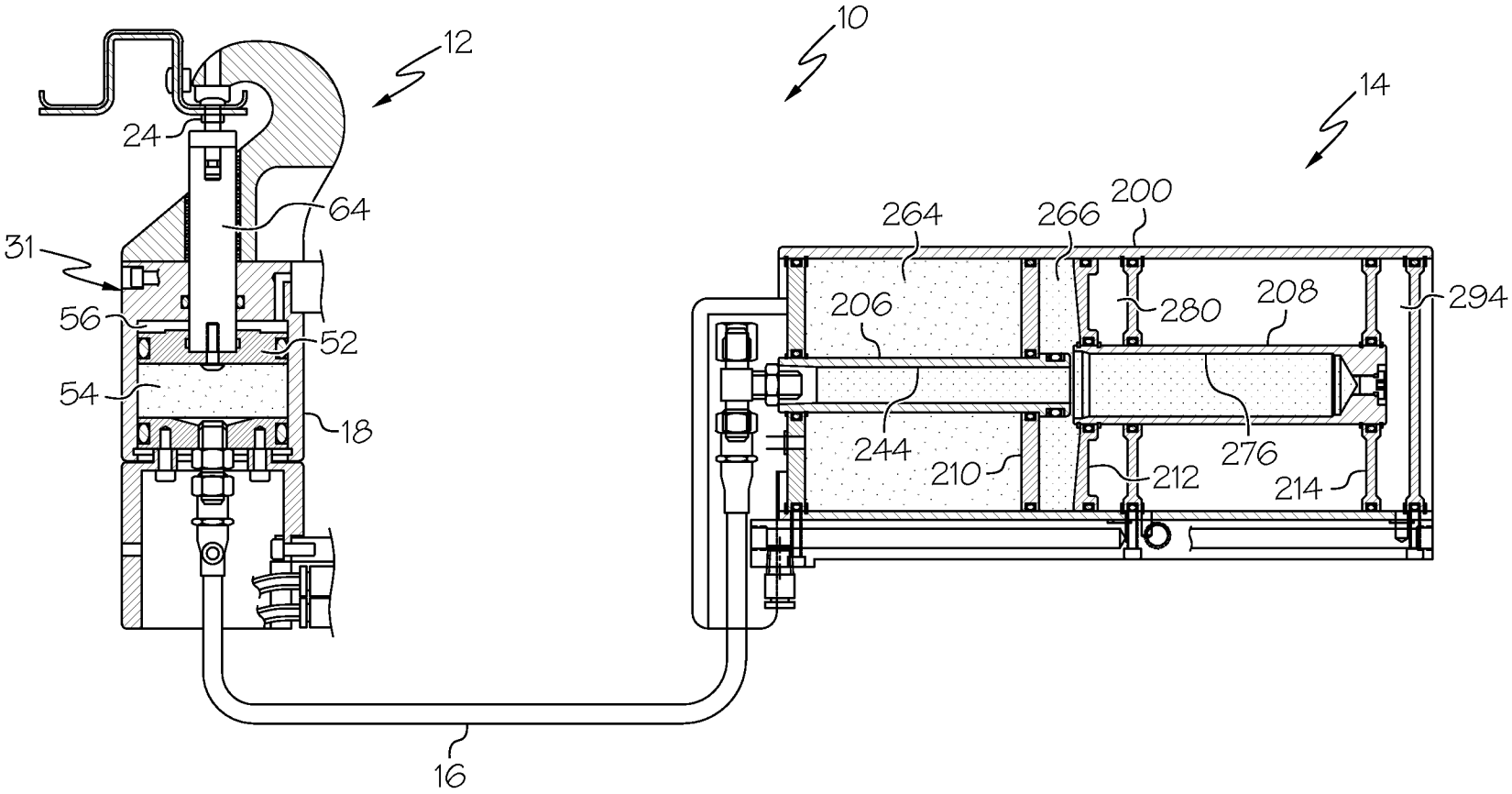
FIG. 7 is a side elevational view, in section, of the rivet squeeze assembly of FIG. 3 shown in a pre-load configuration.

The hydraulic intensifier pump 14 may be actuated from the return configuration shown in FIG. 6 to the pre-load configuration shown in FIG. 7 when a force F (FIG. 4) is applied to the push button 150 (FIG. 4) of the rivet squeeze tool 12 and the force is sufficient to move the push button 150 to the partially depressed position.

Referring to FIG. 7, in the pre-load configuration, the first gas chamber 264 of the hydraulic intensifier pump 14 continues to be pressurized (e.g., 100 psi). However, in the pre-load configuration, the shaft chamber 56 of the rivet squeeze tool 12 is vented, thereby allowing the piston 52 to move toward the first end 31 of the hydraulic cylinder 18.

Additionally, in the pre-load configuration, the second gas chamber 280 may be pressurized (e.g., 100 psi), while the third gas chamber 294 may remain vented. With the first gas chamber 264 and the second gas chamber 280 pressurized, the force (pressure) acting on the second piston 212 may urge the second piston 212 (together with the connected socket shaft 208 and the third piston 214) toward the first piston 210, thereby compressing the hydraulic fluid chamber 266. As the hydraulic fluid chamber 266 is compressed, hydraulic fluid within the hydraulic fluid chamber 266 may be urged through the plug shaft bore 244, through the hydraulic fluid line 16 and, ultimately, into the piston chamber 54 of the rivet squeeze tool 12, thereby urging the shaft 64 of the rivet squeeze tool 12 into engagement with the rivet 24.

While the hydraulic fluid chamber 266 is compressed in the pre-load configuration, both the plug shaft bore 244 and the socket shaft bore 276 may remain in fluid communication with the hydraulic fluid chamber 266 (i.e., the plug shaft 206 may not yet be fully coupled with the socket shaft 208). Therefore, in the pre-load configuration, hydraulic fluid may flow from the hydraulic fluid chamber 266 into the plug shaft bore 244.

Thus, in the pre-load configuration, hydraulic fluid may be pumped from the hydraulic intensifier pump 14 to the rivet squeeze tool 12 to urge the shaft 64 of the rivet squeeze tool 12 into engagement with the rivet 24. However, the squeezing force (e.g., about 400 to about 500 lbs) applied to the rivet 24 in the pre-load configuration may not be sufficient to deform the rivet 24. Deformation may or may not occur when the hydraulic intensifier pump 14 is actuated from the pre-load configuration to the rivet squeeze configuration (FIG. 8).

The hydraulic intensifier pump 14 may be actuated from the pre-load configuration shown in FIG. 7 to the rivet squeeze configuration shown in FIG. 8 when the force F (FIG. 4) applied to the push button 150 (FIG. 4) of the rivet squeeze tool 12 is sufficient to move the push button 150 to the fully depressed position.

Referring to FIG. 8, in the rivet squeeze configuration, the first gas chamber 264 may be vented, while the second and third gas chambers 280, 294 may be pressurized (e.g., 100 psi). The shaft chamber 56 (FIG. 4) of the rivet squeeze tool 12 may remain vented.

With the first gas chamber 264 vented, the first piston 210 may be moveable toward the first end 220 of the cylinder body 200 in response to pressure within the hydraulic fluid chamber 266. Furthermore, with the second and third gas chambers 280, 294 pressurized (or even just one of the second and third gas chambers 280, 294 pressurized), the forces (pressure) acting on the second and third pistons 212, 214, respectively, may urge the connected socket shaft 208 into coupled engagement with the plug shaft 206, thereby pumping hydraulic fluid through the hydraulic fluid line 16.

Thus, in the rivet squeeze configuration, hydraulic fluid at a significantly higher pressure may be pumped from the hydraulic intensifier pump 14 to the rivet squeeze tool 12 to deform the rivet 24. For example, while a squeezing force of only about 440 lbs may be applied to the rivet 24 in the pre-load configuration, a squeezing force of about 13,400 lbs may be applied to the rivet 24 in the rivet squeeze configuration.

Accordingly, the disclosed rivet squeeze assembly 10 may employ a two-stage approach to squeezing rivets. In the first stage, a first volume of hydraulic fluid at a first pressure may be supplied to the rivet squeeze tool 12 (a hydraulic actuator). In the second stage, a second volume of hydraulic fluid at a second pressure may be supplied to the rivet squeeze tool 12. The second volume may be less than the first volume. For example, the second volume may be at most 10 percent of the first volume. The second pressure may be greater than the first pressure. For example, the second pressure may be at least 20 times greater (e.g., about 30 times greater) than the first pressure.

Thus, in the first stage of operation (see the pre-load configuration of FIG. 7), a relatively low force may be used to expeditiously position the rivet squeeze tool 12 on a rivet 24. The speed of this operation is made possible by a relatively large volume of fluid in hydraulic fluid chamber 266. The force generated by the hydraulic intensifier pump 14 during the first stage may be sufficient to move the rivet squeeze tool 12 into touching engagement with the rivet 24 and possibly allow for some adjustment or repositioning of the rivet squeeze tool 12 relative to the rivet 24, but not sufficient to deform the rivet 24. In the second stage of operation (see the rivet squeeze configuration shown in FIG. 8), the hydraulic intensifier pump 14 may generate the force necessary to deform the rivet 24. Therefore, the relatively large force required to deform the rivet 24 is only generated during the second stage of operation, which requires relatively little travel of the shaft 64 compared to the first stage. As such, the pressure remains relatively low during most of the stroke cycle and, therefore, the disclosed hydraulic intensifier pump 14 may be smaller, lighter and less expensive than traditional pumps used to deform rivets. Those skilled in the art will appreciate that a smaller and more lightweight pump may be advantageous for hand-held applications and for use on vehicles, such as aircraft, automobiles, boats and the like, where weight is a significant concern.

Although various examples of the disclosed hydraulic intensifier pump and associated rivet squeeze assembly have been shown and described, modifications may occur to those skilled in the art upon reading the specification. Therefore, it is to be understood that the disclosure is not to be limited to the specific examples provided and that such modifications are intended to be included within the scope of the appended claims.

What is claimed is:

1. A pump comprising:

a cylinder body having a first end opposed from a second end along a longitudinal axis, wherein the cylinder body includes a cylinder bore;

a plug shaft positioned in the cylinder bore, the plug shaft including a first end, a second end, and a plug shaft bore, wherein the first end of the plug shaft is fixed relative to the cylinder body, and wherein the second end of the plug shaft includes a stop;

a first piston sealingly and slideably received within the cylinder bore to partially bound a first gas chamber and a hydraulic fluid chamber, the first piston being sealingly and coaxially received over the plug shaft and axially moveable relative to the plug shaft into engagement with the stop;

a socket shaft positioned in the cylinder bore and axially aligned with the plug shaft, the socket shaft including a first end, a second end, and a socket shaft bore, the socket shaft bore being sized and shaped to sealingly receive the plug shaft;

a second piston sealingly and slideably received within the cylinder bore to partially bound a second gas chamber and partially bound the hydraulic fluid chamber, the second piston being connected to and moveable with the socket shaft;

a third piston sealingly and slideably received within the cylinder bore to partially bound a third gas chamber and a vent chamber, the third piston being connected to and moveable with the socket shaft; and a baffle sealingly received within and connected to the cylinder bore to partially bound the second gas chamber and the vent chamber, the baffle being sealingly and coaxially received over the socket shaft such that the socket shaft is axially moveable relative to the baffle;

wherein, during a first stage of operation, the plug shaft is spaced from the socket shaft and the plug shaft bore and the socket shaft bore are in fluid communication with the hydraulic fluid chamber to define a first volume of hydraulic fluid at a first pressure, wherein, during a second stage of operation, the socket shaft is urged axially toward the plug shaft and the plug shaft bore and the socket shaft bore are in fluid communication with the hydraulic fluid chamber to define a second volume of hydraulic fluid at a second pressure, wherein, during a third stage of operation, the plug shaft is sealingly received in the socket shaft bore and the plug shaft bore and the socket shaft bore are fluidly coupled and fluidly isolated from the hydraulic fluid chamber to define a third volume of hydraulic fluid at a third pressure, and wherein the second volume is less than the first volume, the third volume is less than the second volume, the second pressure is greater than the first pressure, and the third pressure is greater than the second pressure.

2. The pump of claim 1 further comprising a first end cap sealingly connected to the first end of the cylinder body and a second end cap sealing connected to the second end of the cylinder body.

3. The pump of claim 2 wherein the plug shaft is connected to the first end cap.

4. The pump of claim 1 further comprising a coupling in fluid communication with the plug shaft bore.

5. The pump of claim 4 further comprising a hydraulic fluid line fluidly coupled to the coupling.

6. The pump of claim 1 wherein the stop comprises a flanged portion of the plug shaft.

7. The pump of claim 6 wherein the flanged portion is sized and shaped to be sealingly received in the socket shaft bore to fluidly and sealingly couple the plug shaft bore to the socket shaft bore.

8. The pump of claim 6 wherein the flanged portion includes an annular groove and a sealing member is received in the annular groove, and wherein the sealing member forms a fluid-tight seal between the plug shaft and the socket shaft when the plug shaft is received in the socket shaft bore.

9. The pump of claim 1 wherein the second piston is connected to the socket shaft proximate the first end of the socket shaft.

10. The pump of claim 1 wherein the first gas chamber is pressurized and the second gas chamber is vented during the first stage of operation, wherein both the first gas chamber and the second gas chamber are pressurized during the second stage of operation, and wherein the first gas chamber is vented and the second gas chamber is pressurized during the third stage of operation.

11. The pump of claim 1 wherein the third piston is connected to the socket shaft proximate the second end of the socket shaft.

12. The pump of claim 1 further comprising a first end cap sealingly connected to the first end of the cylinder body and a second end cap sealing connected to the second end of the cylinder body, wherein the second end cap partially bounds the third gas chamber.

13. The pump of claim 1 wherein the first gas chamber is pressurized and both the second gas chamber and the third gas chamber are vented during the first stage of operation, wherein the first gas chamber and the second gas chamber are pressurized and the third gas chamber is vented during the second stage of operation, and wherein the first gas chamber is vented and both the second gas chamber and the third gas chamber are pressurized during the third stage of operation.

14. A rivet squeeze tool operatively connected to the pump of claim 1.

15. The pump of claim 1 wherein the first gas chamber is pressurized and both the second gas chamber and the third gas chamber are vented during the first stage of operation, wherein the first gas chamber and the second gas chamber are pressurized and the third gas chamber and the vent chamber are vented during the second stage of operation, and wherein the first gas chamber and the vent chamber are vented and both the second gas chamber and the third gas chamber are pressurized during the third stage of operation.

16. A method of actuating a hydraulic actuator, the method comprising:

coupling the hydraulic actuator to a pump, the pump comprising:

a cylinder body having a first end opposed from a second end along a longitudinal axis, wherein the cylinder body includes a cylinder bore;

a plug shaft positioned in the cylinder bore, the plug shaft including a first end, a second end, and a plug shaft bore, wherein the first end of the plug shaft is fixed relative to the cylinder body, and wherein the second end of the plug shaft includes a stop;

a first piston sealingly and slideably received within the cylinder bore to partially bound a first gas chamber and a hydraulic fluid chamber, the first piston being sealingly and coaxially received over the plug shaft and axially moveable relative to the plug shaft into engagement with the stop;

a socket shaft positioned in the cylinder bore and axially aligned with the plug shaft, the socket shaft including a first end, a second end, and a socket shaft bore, the socket shaft bore being sized and shaped to sealingly receive the plug shaft;

a second piston sealingly and slideably received within the cylinder bore to partially bound a second gas chamber and partially bound the hydraulic fluid chamber, the second piston being connected to and moveable with the socket shaft;

a third piston sealingly and slideably received within the cylinder bore to partially bound a third gas chamber and a vent chamber, the third piston being connected to and moveable with the socket shaft; and a baffle sealingly received within and connected to the cylinder bore to partially bound the second gas chamber and the vent chamber, the baffle being sealingly and coaxially received over the socket shaft such that the socket shaft is axially moveable relative to the baffle;

in a first stage of operation, pressurizing the first gas chamber and venting the second gas chamber and the third gas chamber to position the first piston and the second piston such that the plug shaft is spaced from the socket shaft and the plug shaft bore and the socket shaft bore are in fluid communication with the hydraulic fluid chamber to supply a first volume of hydraulic fluid to the hydraulic actuator, the first volume being supplied at a first pressure;

in a second stage of operation, pressurizing the first gas chamber and the second gas chamber and venting the third gas chamber to move the first piston and the second piston toward each other such that the socket shaft is urged toward the plug shaft and the plug shaft bore and the socket shaft bore are in fluid communication with the hydraulic fluid chamber to supply a second volume of hydraulic fluid to the hydraulic actuator, the second volume being supplied at a second pressure;

in a third stage of operation, venting the first gas chamber and pressurizing the second gas chamber and the third gas chamber to sealingly receive the plug shaft in the socket shaft bore such that the plug shaft bore and the socket shaft bore are fluidly coupled and fluidly isolated from the hydraulic fluid chamber to supply a third volume of hydraulic fluid to the hydraulic actuator, the third volume being supplied at a third pressure, wherein the second volume is less than the first volume, the third volume is less than the second volume, the second pressure is greater than the first pressure, and the third pressure is greater than the second pressure.

17. The method of claim 16 wherein the hydraulic actuator is a rivet squeeze tool.

18. The method of claim 16 wherein the third volume is at most 10 percent of the first volume.

19. The method of claim 16 wherein the third pressure is at least 20 times greater than the first pressure.

* * * * *